US007017762B2

(12) United States Patent
Shane

(10) Patent No.: US 7,017,762 B2
(45) Date of Patent: Mar. 28, 2006

(54) MEDICATION REMINDER SYSTEM

(76) Inventor: Terry Shane, 176 Owen Boulevard, Toronto, Ontario (CA) M2P 1G7

( * ) Notice: Subject to any disclaimer, the term of this patent is extended or adjusted under 35 U.S.C. 154(b) by 0 days.

(21) Appl. No.: 10/445,878

(22) Filed: May 28, 2003

(65) Prior Publication Data

US 2003/0222045 A1 Dec. 4, 2003

Related U.S. Application Data

(60) Provisional application No. 60/383,127, filed on May 28, 2002.

(51) Int. Cl.
*B65D 39/00* (2006.01)

(52) U.S. Cl. ..... 215/230; 215/330

(58) Field of Classification Search ..... 215/203, 215/230, 330, 331; 206/459.1, 459.5, 534; 116/308–320, 298
See application file for complete search history.

(56) References Cited

U.S. PATENT DOCUMENTS

| | | | | | |
|---|---|---|---|---|---|
| 332,208 | A | | 12/1885 | Noel | |
| 398,012 | A | | 2/1889 | Weaver | |
| 623,171 | A | | 4/1899 | Mowry | |
| 2,066,183 | A | * | 12/1936 | McHaffey | 116/308 |
| 2,450,949 | A | | 10/1948 | Gattuccio et al. | |
| 2,587,147 | A | | 2/1952 | Guion et al. | |
| 3,151,599 | A | * | 10/1964 | Livingston | 116/308 |
| 3,604,134 | A | | 9/1971 | Clark | |
| 3,921,568 | A | | 11/1975 | Fish | |
| 4,011,829 | A | * | 3/1977 | Wachsmann et al. | 116/308 |
| 4,345,541 | A | | 8/1982 | Villa-Real | |
| 4,405,045 | A | | 9/1983 | Villa-Real | |
| 4,501,370 | A | | 2/1985 | Kelley | |
| 4,641,759 | A | | 2/1987 | Kelley | |
| 4,729,472 | A | * | 3/1988 | Lubin et al. | 206/315.9 |
| 4,802,438 | A | | 2/1989 | DeJonge | |
| 4,913,083 | A | | 4/1990 | Valvo et al. | |
| 4,920,912 | A | * | 5/1990 | Kirkling | 116/308 |
| 5,009,338 | A | | 4/1991 | Barker | |
| 5,261,548 | A | | 11/1993 | Barker et al. | |
| 5,271,353 | A | | 12/1993 | Besthorne | |
| 5,299,701 | A | | 4/1994 | Barker et al. | |
| 5,377,614 | A | | 1/1995 | Glazer | |
| 5,433,324 | A | | 7/1995 | Leonard | |
| 5,577,335 | A | | 11/1996 | Tucker | |
| 5,638,970 | A | | 6/1997 | Garby et al. | |
| 5,720,392 | A | | 2/1998 | Price | |
| D397,295 | S | | 8/1998 | Shelton-Ferrell | |
| 5,823,346 | A | | 10/1998 | Weiner | |
| 6,152,067 | A | | 11/2000 | Mathison | |
| 6,158,155 | A | * | 12/2000 | Boney | 40/307 |

* cited by examiner

*Primary Examiner*—Lien M. Ngo

(57) ABSTRACT

A cap or closure for medication bottles, containers or vials has a base with a peripheral wall to define a recess. A cover is notably located in the recess below the rim of the peripheral wall. The cover has a marker that is selectively aligned with indica indicating dosage intervals. A one-way mechanism inhibits rotation of the cover relative to the base in one direction, providing the consumer with a simple mechanical device that acts as a reminder of when the next does in a course of medication is due or when the last dose was taken. The closure permits a single cap to serve the needs of different medication frequencies while being inexpensive enough to be included with each container provided by a pharmacy or manufacturer of non-prescription medications or homeopathic products.

22 Claims, 5 Drawing Sheets

MEDICATION REMINDER SYSTEM

This application claims priority from U.S. Provisional Application No. 60/383,127 filed on May 28, 2002.

FIELD OF THE INVENTION

This invention relates to the field of indicators and more specifically to indicators used with containers for pills, capsules, caplets etc. which are provided by pharmacists with prescription medications or by manufacturers of vitamins, dietary supplements, homeopathic medicines etc. More particularly the invention relates to devices that aid in compliance with a dosage regimen.

BACKGROUND OF THE INVENTION

Failure to take a medication when prescribed, or double dosing because a patient has forgotten that he or she already took their medication is a common problem. When taking a new medication, compliance with the physician's instructions is usually fairly good but as the length of the treatment course extends beyond the first few days, patients often become forgetful regardless of their age or mental faculties though these factors may exacerbate the problem.

When taking an antibiotic or other drug treatment, it is often difficult to remember if one has actually taken a pill or merely "intended" to take the pill. As lives become busier and more stressful it becomes harder to remember to take a medication with the prescribed frequency. The problem is compounded when multiple medications with different prescribed dose frequencies are being used at one time.

Research into the issues of prescription medication non-compliance, indicate the significant consequences that result.

The National Pharmaceutical Council estimates that non-compliance costs more than $100 billion a year in the USA alone in increased hospital and nursing home admissions, lost productivity, and premature deaths.

Up to 60% of all medication prescribed is taken incorrectly, or not at all (National Council on Patient Information & Education, 1995).

90% of elderly patients made some medication errors, and 35% make potentially serious errors. Older adults average 2.3 serious medication errors per patient per month (Green et al., 1985).

Even patients who understand and agree with treatment are only 75% compliant (Cramer, 1995).

Physicians themselves take only 75% of prescribed pills correctly (Roth, 1987).

Patients quite possibly are less compliant the more serious their condition. In one study, only 42% of glaucoma patients met minimal criteria for compliance after having been told they would go blind if they did not comply. Among patients who already had gone blind in one eye, compliance rates rose only to 58%! (Meichenbaum & Turk, 1987).

The cost of non-compliance in 1992 was $100 billion, $45 billion to the healthcare industry alone (E-pill, 1999).

Non-compliance is directly responsible for the admission of 380,000 patients to nursing homes each year (23% of all nursing home admissions). In 60% of all nursing home admissions, non-compliance is a greater factor than the person's actual medical condition (Col, Fanale, & Kronholm, 1990; Meichenbaum & Turk, 1987).

Non-compliance leads to 3.5 million hospital admissions annually, or 11% of all admissions. In the elderly, 40% of all admissions are due to medication-related problems. The mean cost per admission in these cases has been estimated at $2,150 (Balkrishnan, 1998).

Non-compliance is the greatest single cause for readmission to hospitals (Meichenbaum & Turk, 1987).

DESCRIPTION OF THE PRIOR ART

Attempts to provide patients with reminder devices have been made for almost as long as patent records have been kept. For example, Noel was granted U.S. Pat. No. 332,208 in December 1885 for a simple paper device that could be attached to a medicine bottle and many other designs have followed over the years.

Existing designs fall into four main categories. The first of these consists of devices where one or more medications are transferred from the original container(s) in which they were supplied by the pharmacist or manufacturer and placed into a different container with multiple compartments, each one corresponding to a day of the week or a time of day. These systems can be simple box-like designs with multiple compartments and lids, or more complex systems including timers, motors and alarms which deny access to medication except at the desired time and deliver the correct pills or caplets with or without an alert. These systems are reusable and must be purchased separately by the end user.

The second type of design relates to devices that are intended as add-on products to the original container itself and that can be stuck on to, or affixed to, a bottle or vial, or alternatively in which the container is inserted or placed into a holder or other device in order to produce the desired effect.

An example of an add-on reminder device is shown in U.S. Pat. No. 5,433,324 issued to Leonard. The Leonard device is separable from the medicine bottle and thus would be typically sold to consumers separate from the medicine and used over and over by the user for different medicines.

Because the Leonard device can be reused once a course of medication is completed the cost of the unit is not of primary concern and the purchase is at the discretion of the patient. Predictably, the Leonard device is not very amenable to being manufactured cheaply enough to be included with each prescription. This limits its usefulness as a device provided as an additional service of a pharmacy or pharmaceutical bottle distributor. Another disadvantage of the Leonard device is that it is not secured to the medicine container making it impractical for those who carry their medication in a purse or pocket.

Items in the first two categories always result in additional costs to the consumer because they require an optional purchase that may or may not be reused on future occasions.

The third type of compliance aid involves custom packaging wherein the package itself acts as the reminder device. Most people are familiar with birth control pill dispensers in which each dose of a medication is located in a blister pack or mechanical device indicating the appropriate day of the week. These forms of packaging are extremely effective but need to be modified for each dosage regimen and they are not interchangeable. They are typically part of the manufacturing process and medications that use them are supplied to the pharmacist pre-packaged ready for final sale.

The final group of compliance devices attempts to design the reminder mechanism into a pre-manufactured container that can be supplied by the pharmacist. In these cases the pharmacist will count the prescribed number of pills or capsules from a bulk container and transfer them to a smaller container that is given to the user to take home. This container bears the instructions on how the medication should be taken. Prior art descriptions involve cap designs, container designs, or both and often involve rotating dials, wheels or other mechanisms to indicate when the next dose is due or when the prior dose was taken.

There are several problems with existing prior art, which explains why they are rarely or never seen by consumers and have not been widely adopted by pharmacists or manufacturers of vitamins or homeopathic medications.

Cost is always a critical factor in this industry. The containers supplied by pharmacists are given away at no additional cost to the consumer with the medication itself As such the cost of the container is critical to the pharmacy and any device costing more than a few cents is unlikely to ever achieve significant sales. The device must therefore be extremely simple to manufacture and very inexpensive to produce.

In addition, in almost every country around the world it is a legal requirement that all prescription medications and all non-prescription medications or products, consumption of a large quantity of which would seriously harm a small child, must be provided in child resistant containers. Since most of these child-resistant mechanisms require twisting, turning, squeezing or pushing, they are not compatible with most prior art devices. The act of opening a bottle or vial with a child-resistant device would typically result in the movement of the indicator device, pointer or ring rendering the reminder highly undependable.

Prior art designs that use dials and rings frequently require that different printed versions be used depending on the dosage frequency. This requires the pharmacist to carry many different components in stock or to assemble each unit based on the frequency required by each prescription. Some designs require the pharmacist or the user to write the dosage schedule on the cap or to transfer pre-printed labels onto it depending on the dosage frequency. Since both time and physical space are at a premium in the average pharmacy and multiple vial sizes must already be carried in stock, the requirement to have multiple caps or dials for each size of vial becomes impractical and anything that requires customisation by the user will not be used. These systems do not lend themselves to changes in dosage for example where a medication is taken once daily for the first week and then more frequently in subsequent weeks.

U.S. Pat. No. 4,440,045 issued to Villa-Real shows an example of a reminder cap and container that demonstrates most of these shortcomings. The Villa-Real cap is expensive to manufacture and therefore would tend to be a cost prohibitive addition to a bottle. The design is incompatible with child-resistant devices, as any attempt to open the container would result in the rotation of the dial designed to be a part of the rim. Finally the Villa-Real cap requires one of multiple rings to be assembled by the pharmacist at the point of dispensing depending on the dosage frequency. This could not be altered if the frequency changed during the prescribing period.

Some recent prior art examples attempt to automate the advancement of the reminder mechanism, moving it to the next occasion each time the cap is either replaced or removed. (See U.S. Pat. No. 5,638,970). Such designs suffer several defects despite their apparent ease of use that may limit their application. Firstly, they are by their nature more expensive to produce and, relying on a mechanical device to advance the reminder, they are potentially subject to failure. Because a pharmacist typically supplies the container with medication, this type of device leaves the pharmacist potentially liable for the consequences of overdose or underdose by the patient if the mechanism fails.

Additionally, because the advancement of the reminder cannot be undertaken manually, the designs do not lend themselves to different dosage regimens using a single cap design or dosage patterns that change over time. Finally in the event that a user opens and closes the container without taking a dose, or medication is skipped for a short or extended time, resetting the reminder to the current date indication requires repetitive opening and closing of the container which is very time-consuming. Situations in which a user would open a bottle without taking medication might include counting the pills to determine how many have been taken or remain, or replacing a pill that was removed in error.

SUMMARY OF THE INVENTION

According to one aspect of the invention, a closure has a base and an upstanding peripheral wall that defines a recess. A cover is located in the recess and rotatable relative to the base. The cover is located below the rim of the wall. Preferably, the cover carries a window and is rotated to align the window with the required indicium carried by the base to indicate dosage. The closure can be incorporated into existing container designs without interfering with child-resistant mechanisms.

BRIEF DESCRIPTION OF THE DRAWINGS

Embodiments of the invention will now be described by way of example only with reference to the accompanying drawings in which.

Figure 1:
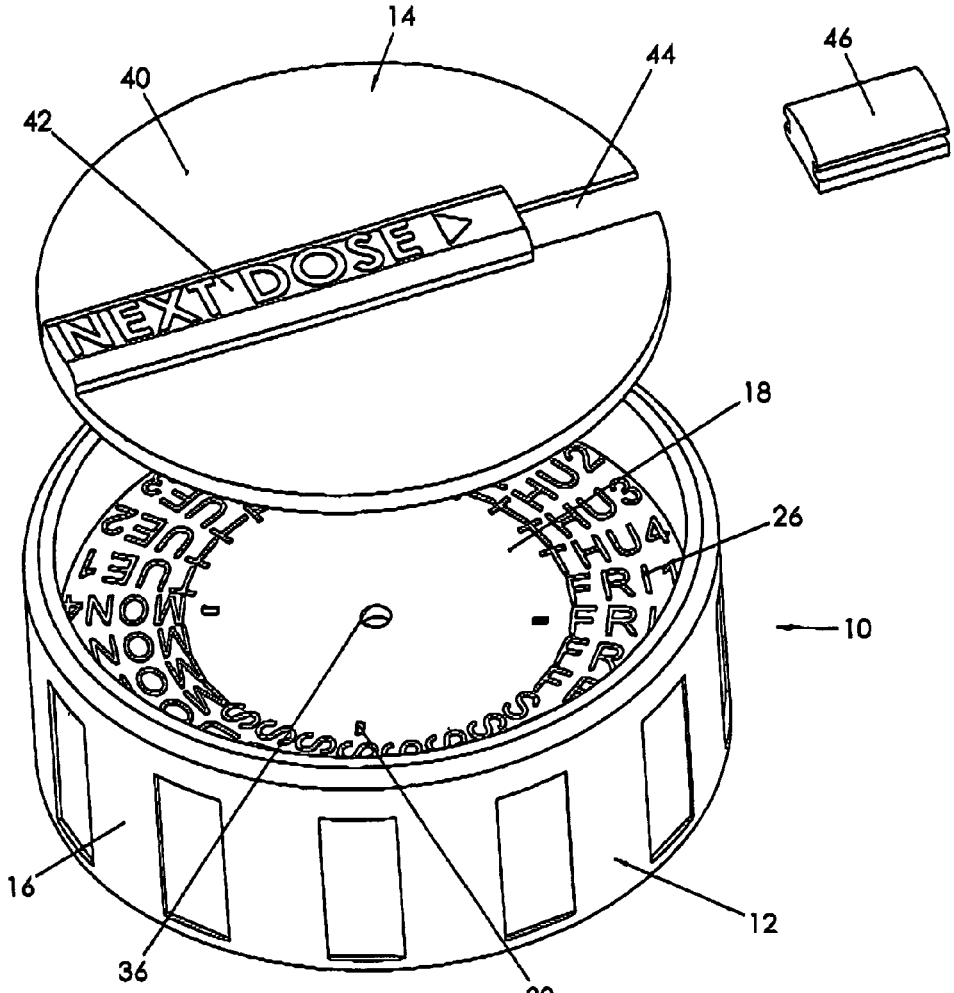
FIG. 1 is an exploded perspective view of a closure.
Figure 2:
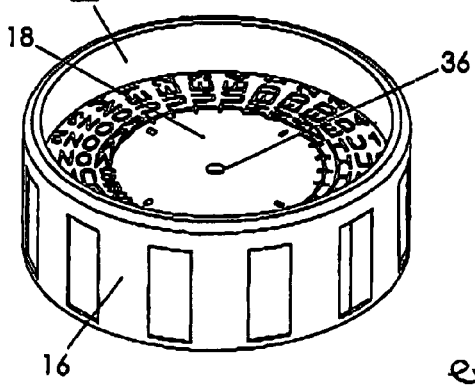
FIG. 2 is a perspective view of the base of the closure shown in FIG. 1.

Referring therefore to FIG. 1, a closure 10 includes a base 12 and a cover 14. The base 12 includes a peripheral wall 16 that projects to either side of a radial wall 18. As can best be seen in FIG. 11, the radial wall 18 and peripheral wall 16 define a pair of oppositely directed counter bores 20, 22. It will be appreciated that the counter bore 20 is configured to match a neck N of a bottle or container shown in ghosted outline. The counter bore 20 may include threads that correspond to the threads on the neck on the container and may also include a mechanism that inhibits removal of the closure by a child. Such a mechanism may be of known construction that requires a combination of rotation and axial movement such as interengaging teeth, biased apart normally but which is not been shown in detail in the drawings.

Figure 3:
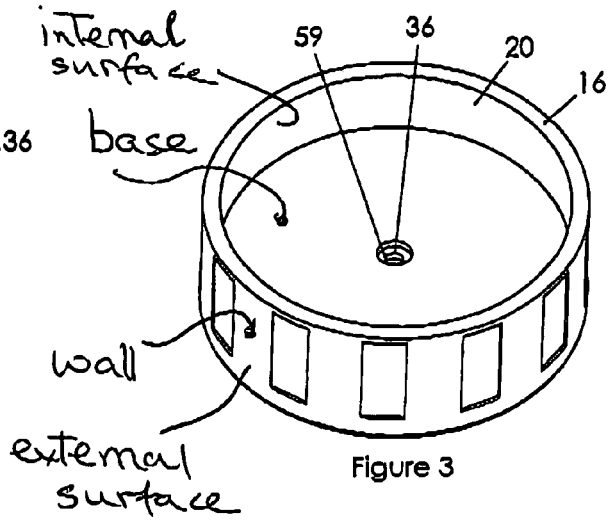
FIG. 3 is a perspective view of the underside of the base shown in FIG. 2.
Figure 4:
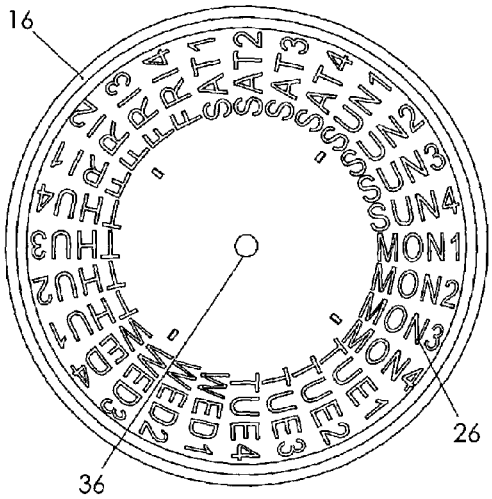
FIG. 4 is a plan view of the base shown in FIG. 2.

The upper surface 24 of the radial wall 18 includes an outer band of indicia 26. The indicia 26 indicate a day and a segment of the day at which the next dose of medication is due or has been taken. Thus in the example shown in FIGS. 1 and 3, it is contemplated that the medication will be taken up to four times per day indicated as, for example SUN 1, SUN 2, SUN 3, and SUN 4.

Figure 10:
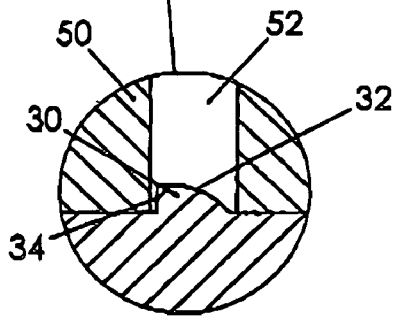
FIG. 10 is a view on an enlarged scale of a portion of the cover shown in FIG. 9.

A set of Cam lobes 30 are formed on the upper surface 24 and are uniformly spaced around the inner circumference of the band 26. As shown in FIG. 10, each lobe 30 has a ramp 32 and an abutment face 34 integrally formed with the ramp 32. In the embodiment shown in FIG. 1, four cam lobes 30 are disposed around the radially inner circumference of band 26.

Figure 5:
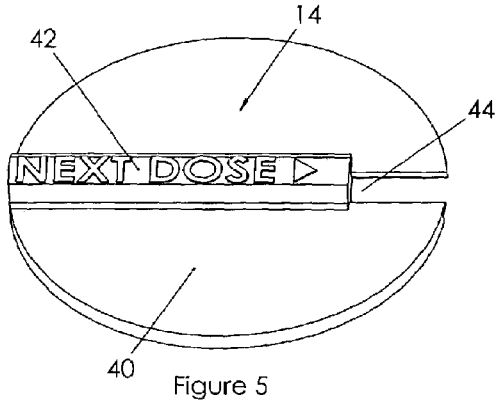
FIG. 5 is a perspective view of the cover of the closure shown in FIG. 1.
Figure 6:
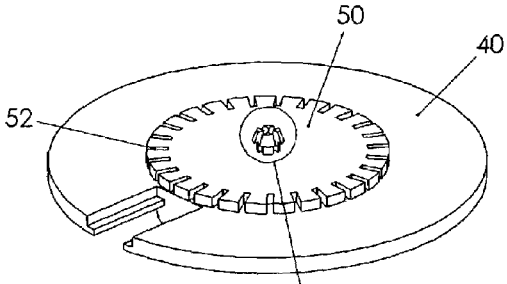
FIG. 6 is a perspective view of the underside of the cover shown in FIG. 5.
Figure 8:
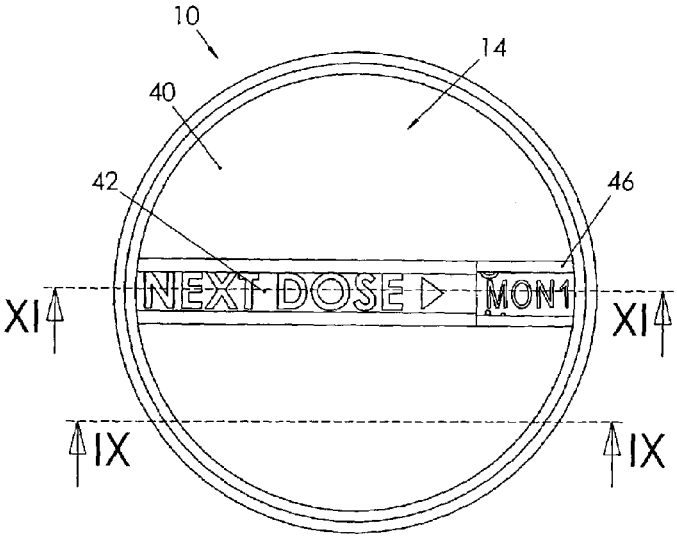
FIG. 8 is a plan view of the assembled closure of FIG. 1.

A central retaining hole 36 is provided in the radial face 18 to secure the cover 14 to the base 12. As seen in FIGS. 5 and 6, the cover 14 includes a body 40 formed as a circular disk with an upstanding bar 42 integrally moulded on a diameter of the disk 40 to facilitate rotation of the cover. A radial slot 44 having a radial extent corresponding to that of the band 26 is formed in the disc 40 in alignment with the bar 42. The upper surface of bar 42 has an indicium indicating "next dose" formed in the surface with an arrow pointing toward the slot 44. A lens 46 engages with flanks of the slot 44 to provide a window in the cover 14.

Figure 7:
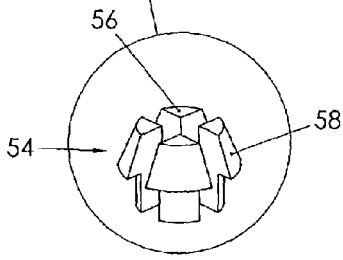
FIG. 7 is a detailed view of a component used on the cover shown in FIG. 6.
Figure 12:
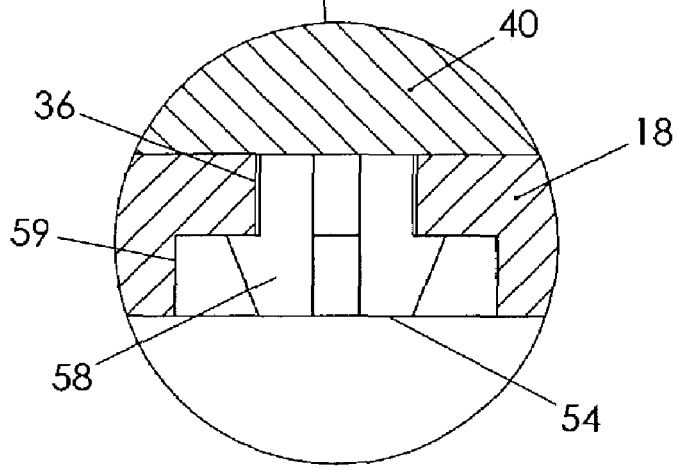
FIG. 12 is an enlarged view of a portion of the closure shown in FIG. 11.
Figure 14:
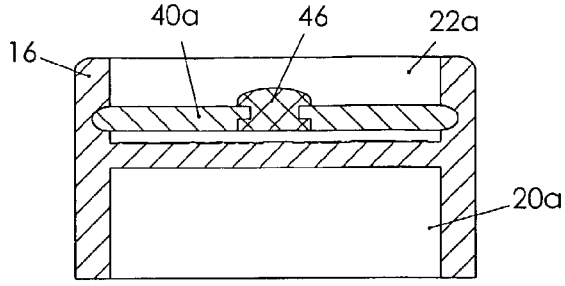
FIG. 14 is a view on the line XIV—XIV of FIG. 13.
Figure 13:
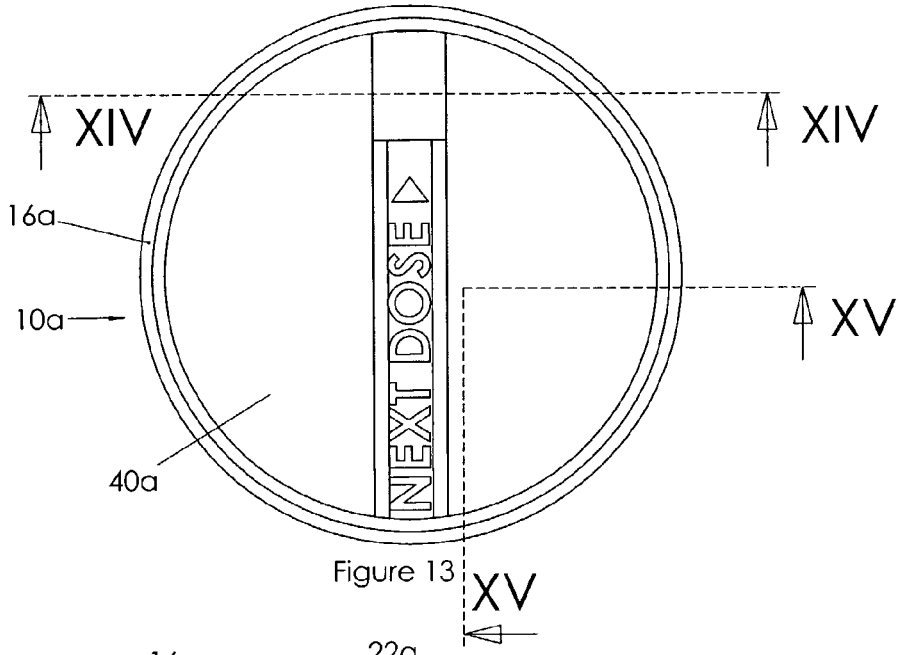
FIG. 13 is a plan view of an alternative embodiment of the closure shown in FIG. 1.
Figure 15:
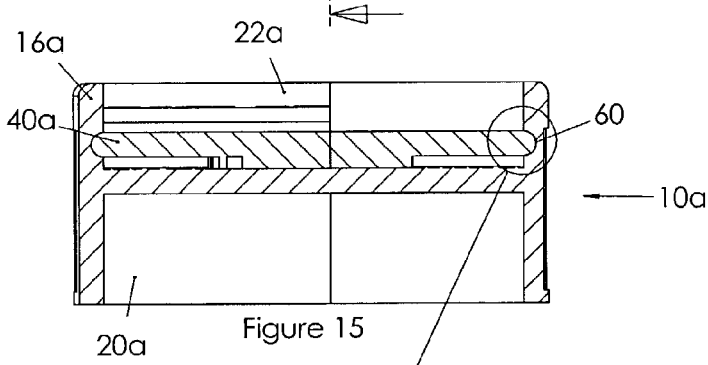
FIG. 15 is a view on the line XV—XV of FIG. 13.
Figure 16:
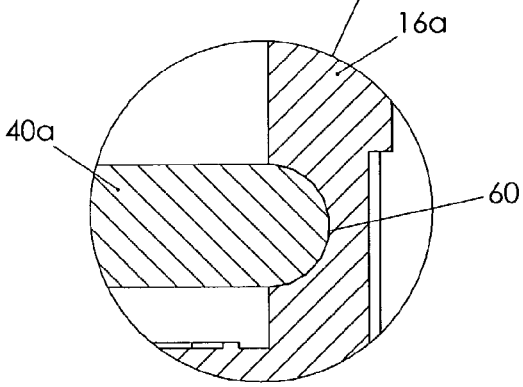
FIG. 16 is a detailed view of a portion of the closure shown in FIG. 15.

The underside of the cover 40 is shown in FIG. 6 and has a ratchet wheel 50 integrally moulded into the disk 14. The ratchet wheel 50 extends to the edge of the slot 44 and has a set of radial slots 52 defining teeth formed at the periphery of the wheel 50, A retainer 54 projects from the underside centre of the cover 40 and has a set of resilient tangs 56 shown in greater detail in FIG. 7 for engagement with the hole 36 in the radial wall 18. Each of the tangs 56 has an enlarged head 58 to pass through the hole 36 and engage in a counter bore 59 provided in the underside of the wall 18 to inhibit removal of the body 40, as can be seen in FIG. 12.

Figure 9:
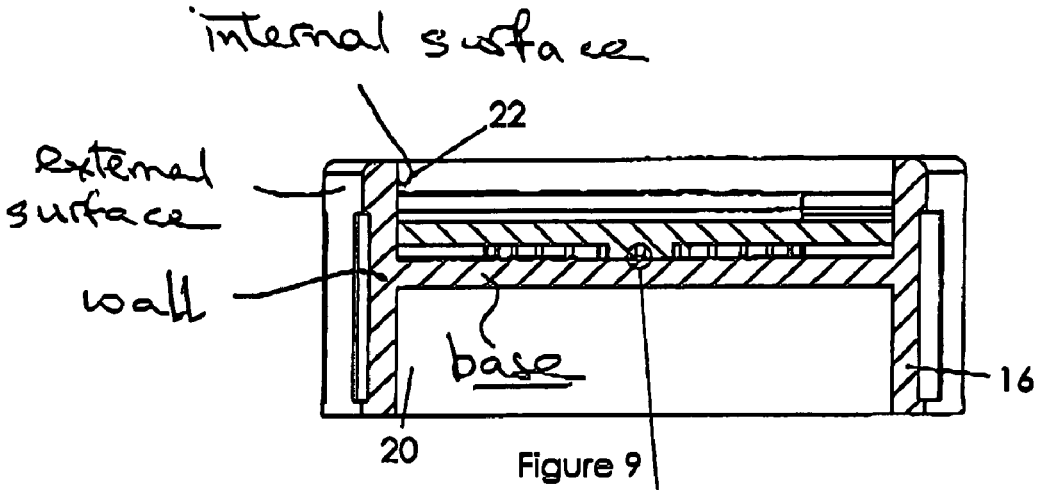
FIG. 9 is a view on the line IX—IX of FIG. 8.
Figure 11:
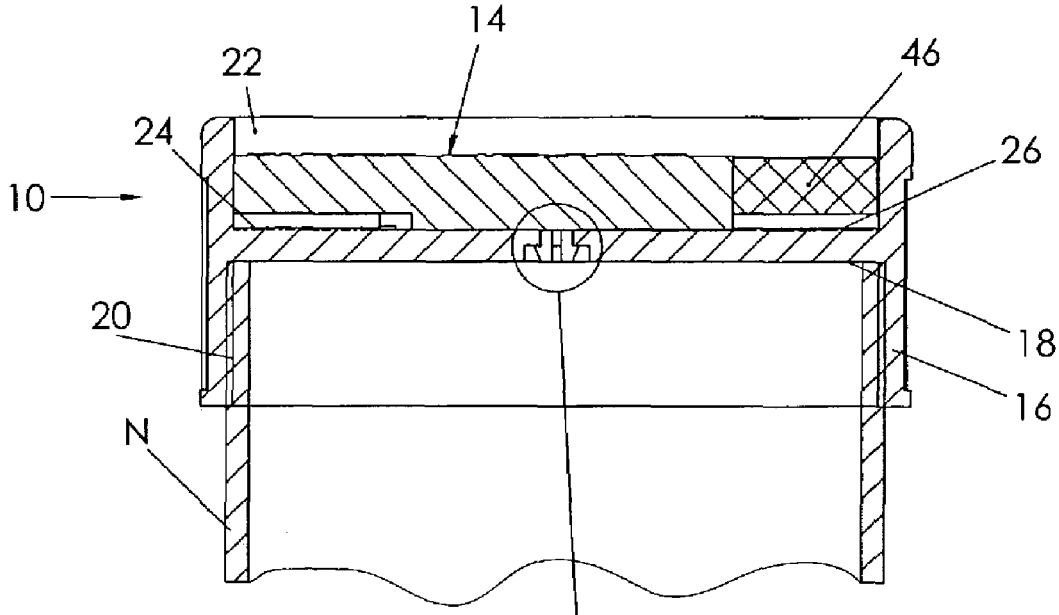
FIG. 11 is a view on the line XI—XI of FIG. 8.

Referring to FIGS. 9 and 11, the body 40 of the cover 14 is dimensioned to fit within the bore 22 and be retained by the retainer 54 on the radial wall 18. The slots 52 of the ratchet wheel 50 accommodate the cam lobes 30 with the abutment face 34 engaging a radial wall of a slot 52 to inhibit rotation in one direction. The cover 40 is thus able to rotate in a direction in which the undersurface of the ratchet wheel 52 rises over the cam 32 but counter rotation is inhibited by the abutment face 34.

When assembled, the window 44 is located over the band of indicia 26 so that a single dosage interval may be viewed through the lens 46. After a dose of medication has been taken, the bar 42 may be used to rotate the disk 40 relative to the base 16 over the cams 32 until the next slot 52 engages with the cam. The next dosage interval is then indicated in the window 44. At each dosage, the disk 40 may be incremented one or more times providing an accurate indication of when the next dose is due. In the event that there is a change in dose frequency or an interruption of medication, the disk 40 may be easily incremented as many times as required to align the window 44 with the appropriate indicium. The recalibration will often be effected in a single sweeping action if appropriate torque is exerted on the bar 42.

It will be noted that the upper surfaces of the bar 42 and disk 40 are maintained below the upper edge of the peripheral wall 16 defining the counter bore 22. The typical spacing between the upper surface of the bar 42, the disk 40 and the top of the wall 16 is in the order of 2 mm although this may be varied depending on particular circumstances. The recessing of the upper surface of bar 42 and disk 40 below the rim inhibits unintentional movement of the disk 40 during removal from, or replacement of, the closure 10 on the container due to any twisting, turning, squeezing, pushing or other motions or the fingers or palms required to defeat the childproof mechanisms or to facilitate use by an elderly or arthritic user. Moreover, as can be seen from FIG. 12, the interaction of the ratchet wheel and the cam 30 prevents rotation of the disk 40 in a counter clockwise direction normally associated with the removal of the closure from the container. Thus the tendency of the disk 40 to rotate due to pressure exerted on the closure 10 to overcome the childproof mechanism is resisted not only by the recessing of the disk but also the orientation of the cams.

The indicia 26 are shown as integrally moulded into the radial wall 18 but the indicia may also be applied through printing of the radial wall 18 or printing on an adhesive disk that may be inserted into the counter bore 22. In this way a range of possible dosage intervals may be incorporated into the closure 16 and the disk incremented past the slots 52 until the next appropriate dosage is visible in the window 44. As a further refinement, the ratchet wheel 50 may be customised for each dosage interval so that the position of the slots 52 corresponds to the dosages indicated on the indicia 26. It will be appreciated that the lens 46 may be removed to leave an open window 44 to view the indicia.

It will also be noted from FIG. 11, that the provision of the ratchet disk 50 maintains the underside of the disk 40 in spaced relationship from the indicia in the band 26 and thereby inhibits erosion due to rotation between the disk 40 and the surface 18.

An alternative embodiment of the closure 16 is shown in FIGS. 13 through 16 in which like reference numerals are used to indicate like components with a suffix "a" added for clarity. In the embodiment of FIGS. 13 through 16, the retainer 56 is replaced by a semi-circular rabbet 60 formed on the radial inner surface of the wall 16*a* in the cavity 22*a*. The disk 40*a* has a diameter greater than that of the bore 22*a* with a rounded edge complementary to the semi-circular recess 60. The disk 40*a* is a snap fit within the recess 60 which permits rotation whilst inhibiting separation in an axial direction.

From the foregoing description, it will be recognised by those skilled in the art that a medicine reminder device offering advantages over the prior art has been provided. It is more economical to manufacture, is compatible with a wide variety of existing and future child-resistant mechanisms and provides a reminder mechanism that works in a wide variety of dosing schedules.

In the foregoing specification, the invention has been described with reference to specific preferred embodiments and methods. It will, however, be evident to those of skill in the art that various modifications and changes may be made without departing from the broader spirit and scope of the invention as set forth in the attendant claims. The specification and drawings are, accordingly, to be regarded in an illustrative, rather than restrictive, sense.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A closure for a container comprising a base; an upstanding peripheral wall formed as a single unitary component with said base and having an external surface for gripping to permit removal of said closure from a container and an internal surface oppositely directed to said external surface, said wall extending from said base to a rim to define a recess on one side of said base; a cover rotatably supported in said recess intermediate said base and said rim, said cover having a marker thereon for selective alignment with indicia carried by said closure and indicative of a dosage interval, said cover being spaced from said rim sufficiently to avoid contact and accidental rotation thereof relative to said base upon removal of said closure from a container; and a mechanism acting between said cover and said base to inhibit relative rotation in one direction.

2. A closure according to claim 1 wherein said cover extends over indicia carried by said base and said marker includes a window to permit viewing of said indicia.

3. A closure according to claim 2 wherein a lens in mounted in said window to magnify said indicia.

4. A closure according to claim 2 wherein said marker includes a bar upstanding from said cover and aligned with said window, said bar facilitating rotation of said cover relative to said base.

5. A closure according to claim 1 wherein said one direction corresponds to the direction of rotation to permit removal of said closure from a container.

6. A closure according to claim 1 wherein said mechanism includes a cam lobe having a ramp and an abutment face on one of said base and cover and a wall engagable with said cam lobe on the other of said base and cover, said wall engaging said abutment face to inhibit relative rotation in said one direction.

7. A closure according to claim 6 wherein said base carries indicia adjacent said peripheral wall.

8. A closure according to claim 7 wherein said indicia are integrally formed in said base.

9. A closure according to claim 8 wherein said indicia are formed as a peripheral band extending about said base.

10. A closure according to claim 7 wherein said indicia are carried on a disc secured to said base.

11. A closure according to claim 1 wherein said cover is rotatably supported on a pivot located on said base.

12. A closure according to claim 11 wherein said pivot is formed by a pin that projects from said cover and is received in an aperture in said base.

13. A closure according to claim 12 wherein a plurality of slots are disposed about said pin to provide a plurality of walls engagable with cam lobes formed on said base.

14. A closure according to claim 1 wherein said cover is rotatably mounted on said peripheral wall.

15. A closure according to claim 14 wherein a groove is provided in said peripheral wall and said cover is received in said groove.

16. A closure for a container comprising a base; an upstanding peripheral wall integrally formed with said base and having an external surface for gripping to permit removal of said closure from a container, said wall extending from said base to a rim to define a recess on one side of said base; a cover rotatably supported in said recess intermediate said base and said rim, said cover having a marker thereon for selective alignment with indicia carried by said closure and indicative of a dosage interval, said cover extending over indicia carried by said base and being spaced from said rim sufficiently to avoid contact and accidental rotation thereof relative to said base upon removal of said closure from a container, said cover including a window to permit viewing of said indicia; and a mechanism acting between said cover and said base to inhibit relative rotation in one direction.

17. A closure according to claim 16 wherein a lens is mounted in said window to magnify said indicia.

18. A closure according to claim 16 wherein said marker includes a bar upstanding from said cover and aligned with said window, said bar facilitating rotation of said cover relative to said base.

19. A closure according to claim 16 wherein said base carries indicia adjacent said peripheral wall.

20. A closure according to claim 19 wherein said indicia are integrally formed in said base.

21. A closure according to claim 20 wherein said indicia are formed as a peripheral band extending about said base.

22. A closure according to claim 19 wherein said indicia are carried on a disc secured to said base.

* * * * *